US005452709A

United States Patent [19]

Mealer

[11] Patent Number: 5,452,709

[45] Date of Patent: Sep. 26, 1995

[54] TIERED-LOGS GAS-BURNING HEATERS OR FIREPLACE INSERT

[75] Inventor: W. Burgain Mealer, Cleveland, Tenn.

[73] Assignee: G.I.W. Management, L.L.C., Cleveland, Tenn.

[21] Appl. No.: 292,469

[22] Filed: Aug. 18, 1994

[51] Int. Cl.[6] ..... F24C 3/00

[52] U.S. Cl. ..... 126/512; 126/92 AC; 431/125

[58] Field of Search ..... 126/512, 92 R, 126/92 AC, 85 R, 91 R, 531, 86; 431/125

[56] References Cited

U.S. PATENT DOCUMENTS

| | | | |
|---|---|---|---|
| 3,291,116 | 12/1966 | Brooks | 126/92 R |
| 4,883,043 | 11/1989 | Thow et al. | 126/512 |
| 5,069,200 | 12/1991 | Thow et al. | 126/512 |
| 5,114,336 | 5/1992 | Karabin et al. | 126/512 |
| 5,139,011 | 8/1992 | Moon | 126/512 |

*Primary Examiner*—James C. Yeung
*Attorney, Agent, or Firm*—Paul E. Hodges

[57] ABSTRACT

A gas-burning heater or fireplace insert including a plurality of tiered artificial logs with gas burners disposed strategically between the tiers. The burners at each tier are selected to provide a particular flame pattern, with one or more of the flame patterns being developed in combination with one or more of the logs to promote the generation of localized heat that enhances the visual appearance of the flames of the pattern and increases the heat radiated outwardly of the insert and into the ambient environment. In a preferred embodiment, the insert is capable of operating in a non-vented environment. A method for operating a gas-burning heater or fireplace insert is disclosed as are various unique aspects of the invention including subassemblies of the insert.

13 Claims, 6 Drawing Sheets

TIERED-LOGS GAS-BURNING HEATERS OR FIREPLACE INSERT

FIELD OF INVENTION

This invention relates to Gas-burning heaters or fireplace inserts which employ artificial logs, and more particularly to inserts which utilize multiple-tiered artificial logs.

BACKGROUND OF THE INVENTION

Wood burning fireplaces in a home have long been the source of both heat for warming of the house and as an attractive and appealing object to visually observe. Entire room arrangements are commonly focused on an open fireplace to permit the enjoyment of the warmth and enchantment of the burning wood within the fireplace.

Unfortunately, the burning of wood in a fireplace presents the problems of obnoxious smoke and soot, and of the inconveniences associated with keeping the fireplace area clean and the acquiring, storage and transport of the wood for burning.

Gas burning heaters or fireplace inserts (hereinafter referred to at times collectively as "insert" or "fireplace insert") which include artificial logs have become very popular in American households as a substitute for burning of wood in the fireplace. These inserts commonly burn natural gas or propane and are clean and convenient to operate. To their distraction, these inserts heretofore have not been capable of realistically simulating burning wood logs. Further, the cost of construction of the fireplace itself is not diminished by reason of one using a gas-burning fireplace insert in that the inserts frequently require a proper vent to the outside of the house to exhaust carbon monoxide combustion products from the burning gas. More recently, it has become acceptable to construct non-vented fireplaces, but only if the carbon monoxide level of the burning gas does not exceed 200 ppm and if the total BTU output of the insert is not greater than 40,000 BTU. These limitations on the level of carbon monoxide and total BTU output generated by the burning gas severely restricts the manner of operation of gas-burning inserts. For example, the most efficient burning of natural gas or propane, hence the least carbon monoxide produced, occurs when there is a proper (i.e. stoichiometric) mixture of air, or other source of oxygen, and gas. The flame produced under these conditions of combustion is characteristically blue in color. Yellow tips to the flames are pleasing to observe, but they indicate oxygen deficiency and generation of carbon monoxide. Further, in order to maintain the level of carbon monoxide at or below the permissible level for a non-vented fireplace, as well as limit the total BTU output of the insert, one is limited as to the quantity of gas made available for combustion. The use of multiple burners in the insert compounds the problems facing a designer of these inserts, particularly where it is desired to provide for control over the rate of combustion to selectively adjust the BTU output downwardly from a maximum, i.e. to select "low", "medium" and "high" heat outputs from the insert.

Attempts to enhance the flame colors have included various techniques, such as use of logs having a coating thereon which alters the color of a flame where it contacts the coated log. This type of practice is not cost effective because of the initial cost of the coatings material and its application to the logs, and because the coating commonly is fugitive.

In accordance with the;present invention there is provided a gas-burning fireplace insert which may be employed in a nonvented fireplace and which effectively simulates burning wood logs and provides the aesthetically pleasing and entrancing appearance of the flames associated with burning wood logs.

It therefore is an object of the present invention to provide an improved gas-burning fireplace insert.

It is another object to provide a non-vented gas-burning fireplace insert.

It is another object to provide a gas-burning fireplace insert which employs tiered artificial logs and selected colored flames associated with each tier.

It is another object of the present invention to provide an insert having multiple burners which have characteristically unique flame patterns and/or color.

It is another object of the present invention to provide an insert having a novel gas and/or combustion air distribution system.

It is another object of the present invention to provide a gas-burning insert having multiple burners and selective control over the total heat output of the burners to a value less than about 40,000 BTU.

It is another object of the present invention to provide a gas-burning insert in which there is generated less than about 200 pm carbon monoxide.

Other objects and advantages of the present invention will be recognized from the description thereof contained herein including the claims and the drawings, in which:

SUMMARY OF THE INVENTION

Figure 1:
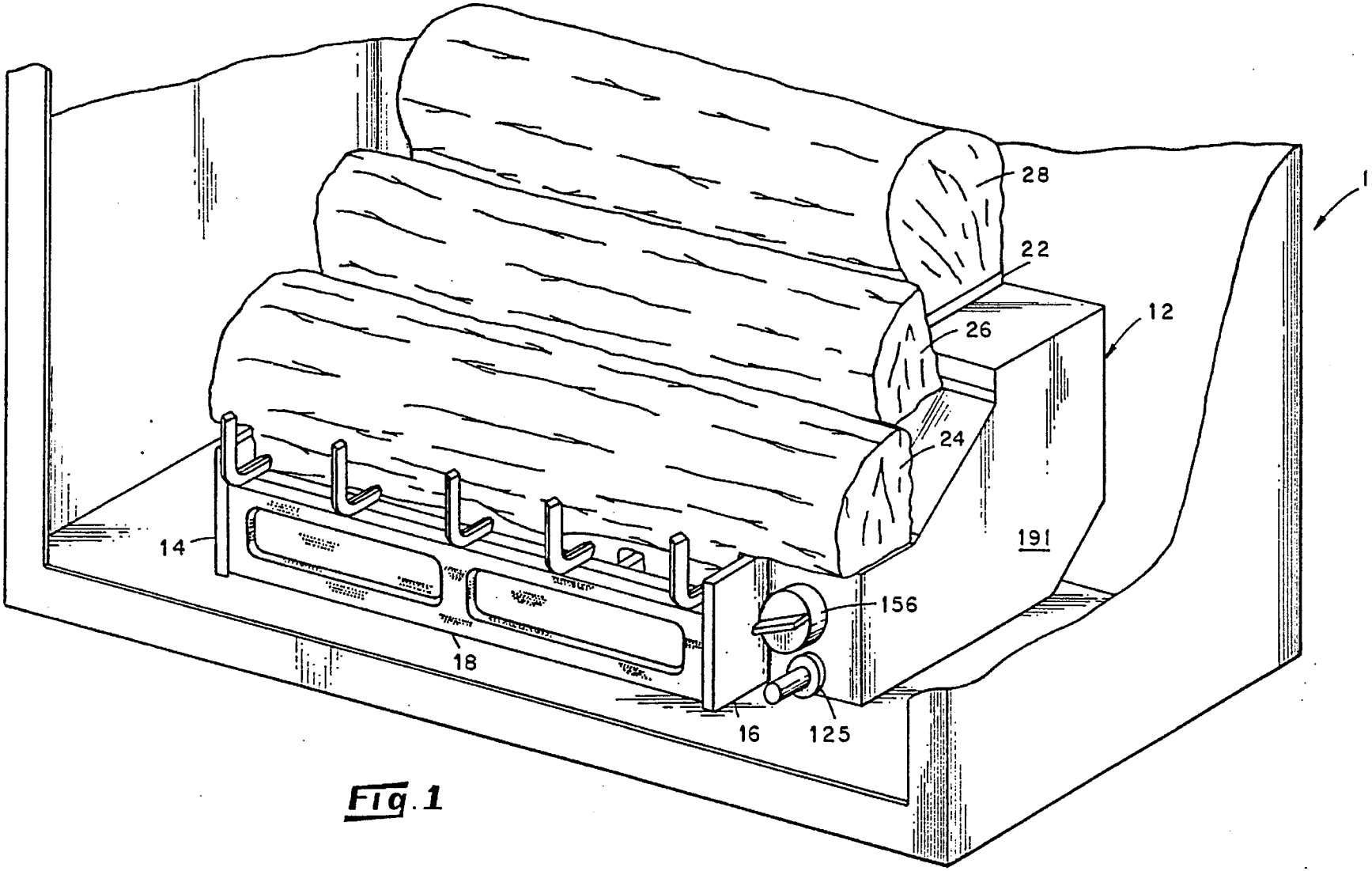
FIG. 1 is a perspective view of an insert embodying various of the features of the present invention.

The present invention is an improved gas-burning heater or fireplace insert which includes a plurality of multi-tiered artificial logs with gas burners disposed strategically between the tiers. The burners at each tier are selected to provide a particular flame pattern, with one or more of the flame patterns being developed in combination with one or more of the logs to promote the generation of localized heat that enhances the visual appearance of the flame of the pattern. This enhanced flame-log interaction also increases the heat radiated outwardly of the insert and into the ambient environment for a given level of combustion. In a preferred embodiment, the insert is capable of operating in a non-vented environment.

More specifically, in the present invention, in a preferred embodiment, at least three tiers of artificial logs are disposed on a support with gas burners disposed at each level of the tiered logs. All the burners are fed from a single gas inlet conduit with the incoming gas stream being distributed unequally to the burners so as to generate different flame patterns at selected vertical levels of the logs. In accordance with one aspect of the invention, burners associated with the lower two levels of logs are regulated to produce yellow flames and a burner associated with the uppermost tier of the logs is regulated to produce relatively hot blue flames which are directed against an inclined surface of a log of the uppermost tier. These flames, in combination with the inclined log surface, cause the log surface to glow red such that the flames of the uppermost burner appear to the viewer as being red also. Neat gas is supplied to the lower burners so that combustion air is derived from the ambient environment within the enclosure for these burners, while the gas supplied to the upper burner is premixed with air. Regulation of the flames of the lower two levels of burners takes the form of restricted flow of gas to these burners, hence a lower level of combustion and concomitant lower level of carbon monoxide generation at these levels. The relatively hot, and efficient combustion of the neat gas at the uppermost level of burners inherently produces little carbon monoxide, so that the combined level of carbon monoxide produced by the several burners of the insert does not exceed a permissible level.

In accordance with a further aspect of the invention, there is provided control means for selectively regulating the volume of gas made available to the respective burners to establish combustion levels at the respective burners, the total heat output therefrom being less than a preset maximum, such as 40,000 BTU. In another aspect, the gas supplied to the respective burners is chosen between neat gas and gas premixed with air to effect desired flame patterns and color at respective burners. Still further, the invention includes a unique gas distribution system for delivering the gas to the respective burners, and in at least one instance, including means for premixing the gas with air prior to introducing the mixture to a burner.

A still further aspect of the invention includes one or more gas feed subassemblies whose designs enhance the manufacture of the present insert by assuring proper physical association of certain of the critical components of the insert and by easing the assembly of the insert, and aid in assuring that factory-preset gas and/or gas/air mixture flow to the respective burners is not readily alterable in the field such as might cause the insert to be out of specification for non-vented operation, for example.

DETAILED DESCRIPTION OF THE INVENTION

With reference to the several Figures in which like components are provided with like numerals, there is depicted one embodiment of an insert embodying various of the features of the invention including a housing 10 for containing the insert which is indicated generally by the numeral 12. The housing 10 in the depicted embodiment is in the form of a metal enclosure, for example, but the housing may take the form of a conventional fireplace within which the insert is located.

Figure 3:
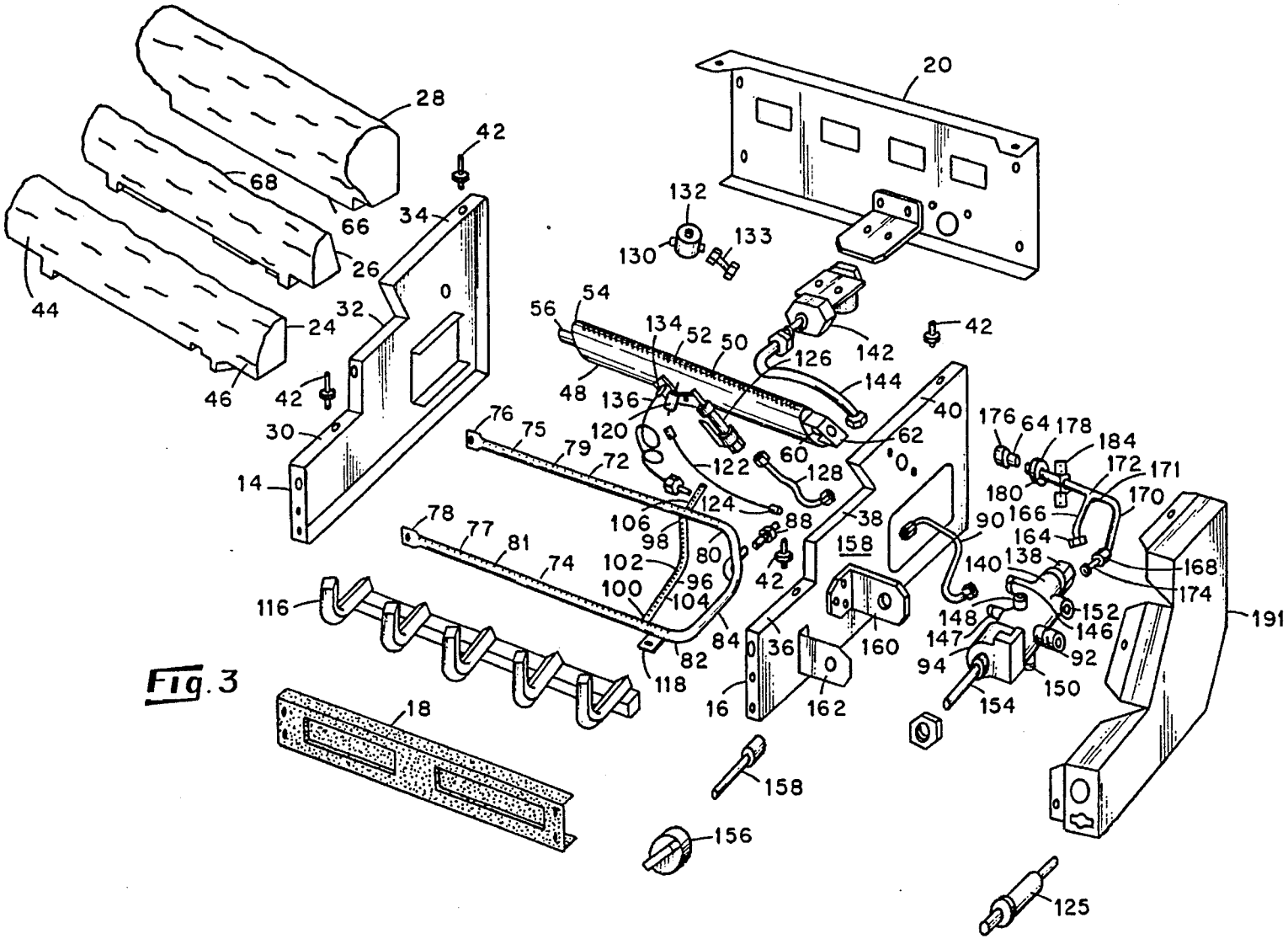
FIG. 3 is a diagrammatic exploded view of various components of one embodiment of the present invention.
Figure 4:
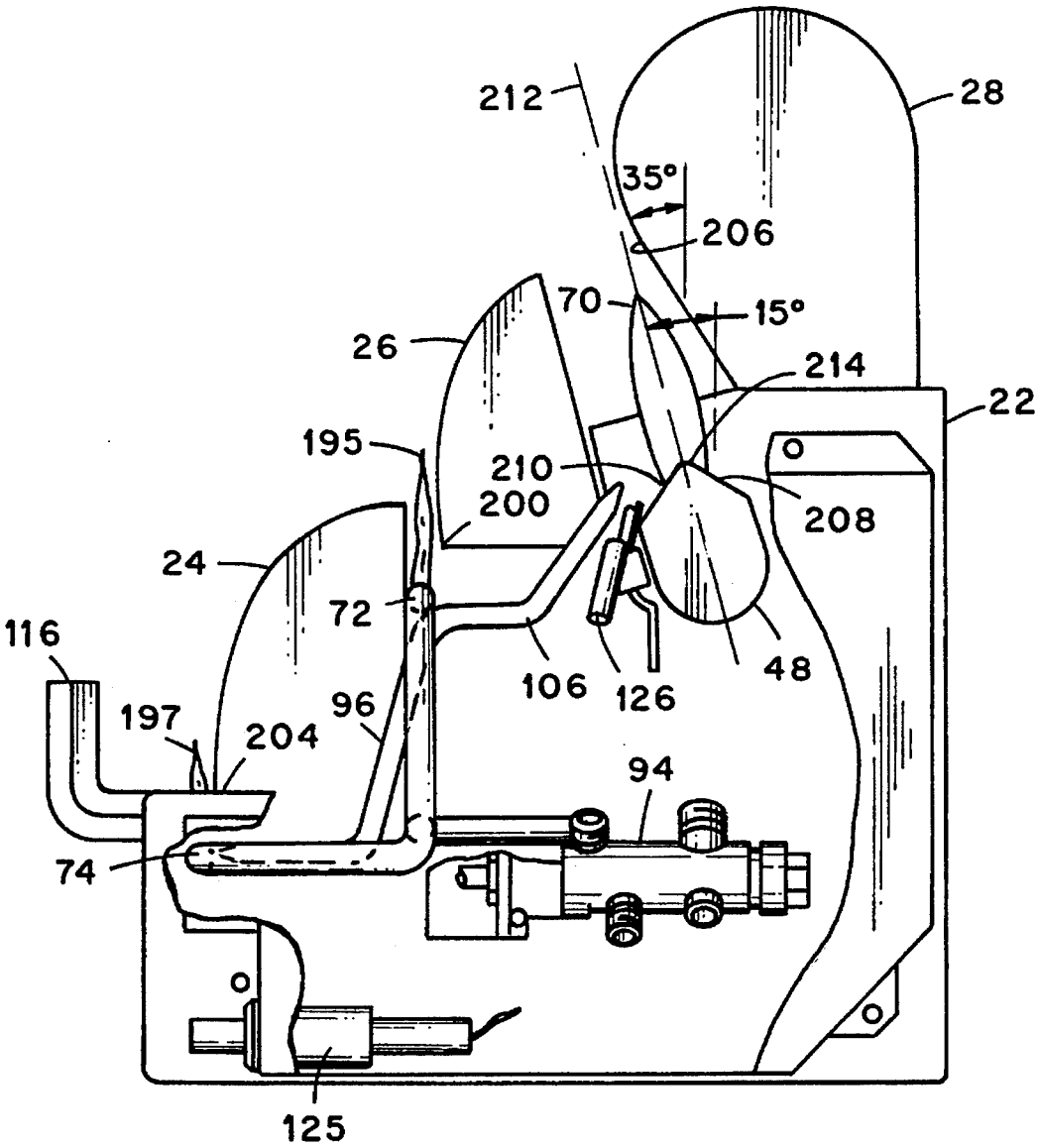
FIG. 4 is an end view, partly cutaway and showing only limited components, of the insert depicted in FIG. 1.
Figure 5:
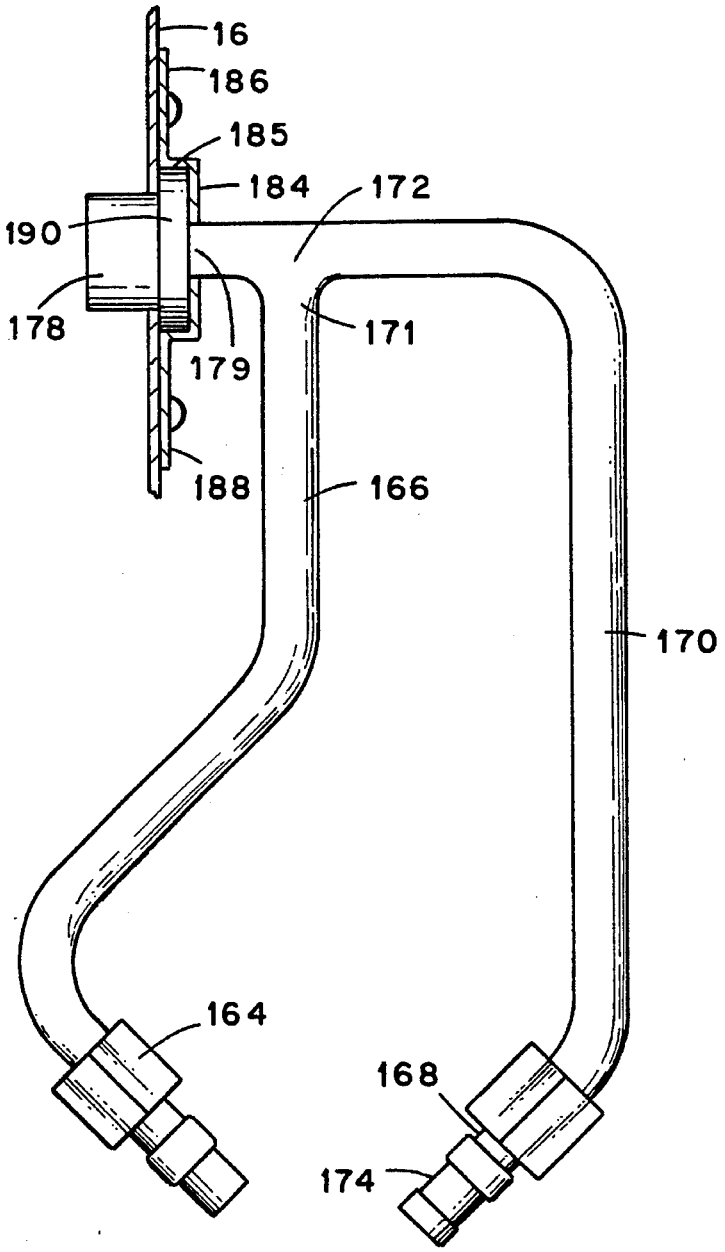
FIG. 5 is plan view of a gas feed subassembly for the main burner of an insert and embodying various of the features of the present invention.
Figure 6:
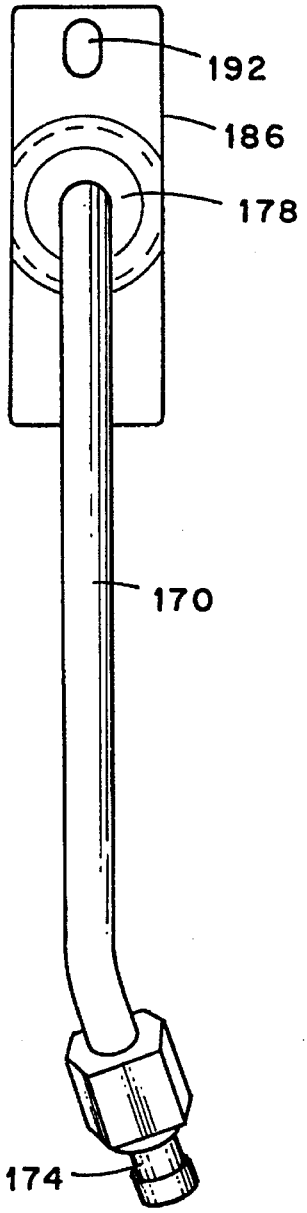
FIG. 6 is a side view of the gas feed subassembly depicted in FIG. 5.
Figure 7:
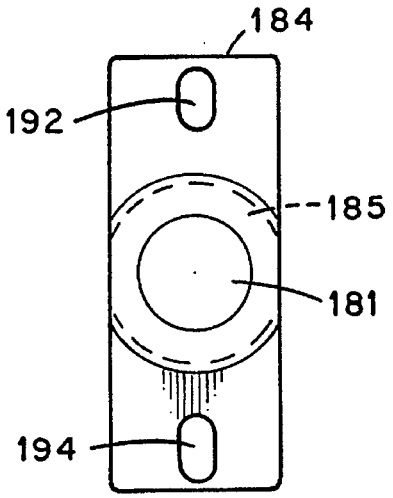
FIG. 7 is a plan view of one embodiment of a bracket for affixing the gas feed subassembly of FIG. 6 to an end panel of an insert as depicted in FIG. 1.
Figure 8:
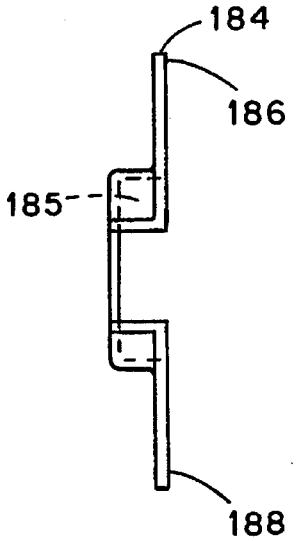
FIG. 8 is a side view of the bracket depicted in FIG. 7.
Figure 10:
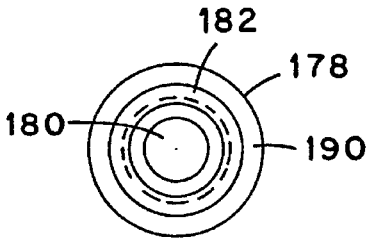
FIG. 10 is an end view of the left-hand end of the flanged fitting of FIG. 9.
Figure 9:
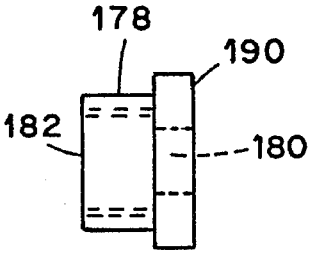
FIG. 9 is a side view of a flanged fitting employed in the gas feed subassembly depicted in FIG. 6.
Figure 11:
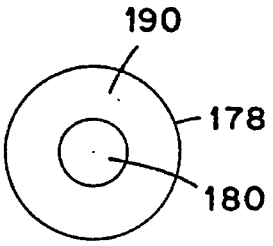
FIG. 11 is a end view of the right-hand end of the flanged fitting of FIG. 9.

The depicted insert 12 includes left and right-hand end panels 14 and 16, respectively, that are connected in spaced apart relationship as by means of a front panel 18 and a rear panel 20. These panels, in combination, define a support indicated generally at 22 for at least three artificial logs 24, 26 and 28 at three levels of vertical displacement and three locations of forward to rearward displacement of the logs as best seen in FIGS. 3 and 4. To this end, each of the end panels 14 and 16 is provided with three steps 30, 32, and 34 on end panel 14, and 36, 38 and 40 on end panel 16. Placement pins 42 which are anchored to the end panels at one or more of the steps are received in outwardly opening bores in the bottom surfaces of the ends of the logs, ends 44 and 46 of the log 24, for example. These pins ensure positioning of the logs precisely upon the steps of the support, and may be positioned on a step, or formed of a specific cross sectional geometry, as ensures that each log is located on its proper step for reasons that will appear hereinafter.

Positioned within the confines of the support 22, there is provided a main burner 48 which is tubular in form and on its top side 50 is provided with a plurality of burner ports 52 along the length thereof. In the depicted embodiment, one end 54 of the main burner is closed and includes a stub shaft 56 which serves to mount the end of the main burner in an opening 58 in the left hand end panel 14. The opposite end 60 of the main burner is open and is anchored to the right hand end panel 16 as by means of a bracket 62. The bracket 62 is designed to cause the open end 60 of the main burner to be positioned in spaced apart relationship to the right-hand end panel 16 and in position to operatively receive a gas feed orifice 64 in juxtaposition thereto. The vertical and front to rear location of this main burner is chosen such that the burner is disposed between and below the bottom side 66 of the top log 28 and below the upper side 68 of the middle log 26, thereby causing the flames 70 (see FIG. 4) from this burner to be directed upwardly between the top and middle logs. This main burner is the largest of the several burners of the insert and is capable of generating larger quantities of heat relative to the other burners of the insrt, for example, at least twice the heat output as is generated by all other burners of the insert combined. One suitable burner for use as the main burner of the present insert is that sold by Worgas Bruciatori s.r.l. of Formigine (MO) Italy under the tradename WORGAS, Type 50.3.40 -2SF.

Two further tubular burners are provided in the depicted embodiment of the present invention, these burners being designated as a middle burner 72 and a lower burner 74. As best seen in FIG. 4, the middle burner 72 is positioned between the logs 24 and 26 and the lower burner 74 is positioned between the log 24 and the front panel 18. Each of these burners is provided with a plurality of aligned burner ports 75 and 77, respectively, in the upper sides 79 and 81, respectively, thereof. One end 76 of the middle burner is secured to the left-hand end panel 14 of the support 22 and extends therefrom to a location just short of the right-hand end panel 16. One end 78 of the lower burner 74 is secured to the left-hand end panel 14 also and extends therefrom to a location just short of the right-hand end panel 16. The opposite ends 80 and 82 of the middle and lower burners 72 and 74, respectively, are connected in fluid communication with one another as by means of a cross-over tube 84. Centrally of the cross-over tube 84 there is provided a conduit 90 adapted to serve as a gas inlet to the cross-over tube 84, hence to the middle and lower burners 72 and 74. This conduit 90 is connected to one outlet 92 of a multi-functional control valve 94. A flow restricting orifice 88 is interposed along the length of the conduit 90. At a location along the length of, and spaced about one-fifth of the distance from the ends 76 and 78 of the middle and lower burners, there is provided a first ignition tube 96 which is in fluid communication at its upper end 98 with the middle burner 72 and is closed at its lower end 100. A line of burner ports 102 are provided in the outer side 104 of this first ignition tube 96 so that a flame ignited at its upper end 98 will propagate to its lower end 100 and serve to ignite the lower burner 74 following ignition of the middle burner 72. As will appear more fully hereinafter, ignition of the middle burner 72 is effected by means of a second ignition tube 106 which has its lower end 108 fixedly mounted to and in fluid communication with the middle burner 72 and its upper end 110 closed and disposed adjacent the main burner 48. A line of burner ports 112 are provided on the outer side 114 of this second ignition tube 106 so that when gas is introduced to the middle burner 72, the gas rises within the second ignition tube 106 to become ignited by a flame of the main burner. This flame propagates down the gas-filled ignition tube to ignite the middle burner and continues downwardly to ignite the lower burner. The size of the burner ports in each section of the ignition tube is chosen to be minimal to preclude the flames from the ignition tube from interfering with or overpowering the desired effect of the flames from either of the burners 48, 72, or 74, and especially the middle and lower burners.

A grate 116 preferably is provided in the lower and forward portion of the support 22, primarily for aesthetic purposes. As desired, the end 82 of the lower burner 74 may be anchored to the grate 116 as by means of a tab 118.

In the depicted embodiment, the insert is also provided with a conventional igniter which may be of the hot surface type in which silicon carbide is heated by an electrical current flowing therethrough, or preferably may take the form of a piezo-electric spark generator or other functionally equivalent ignition means. This igniter, importantly, is located adjacent the main burner inasmuch as in the present invention, all gas ignition activity of the insert commences at the main burner. The depicted igniter includes an electrical lead 122 having a terminal end 124 suitable for plugging into a piezo-electric generator 125.

Preferably, an oxygen depletion sensor pilot assembly 126 is also provided at a location adjacent the main burner, and in this situation, the igniter serves to strike a flame from the pilot assembly, such flame being in position to ignite gas flowing into the main burner. As depicted, a conduit 128 leads from the pilot assembly to an outlet port 130 on a pilot regulator 132 for the controlled supply of gas to the pilot assembly. This pilot regulator, in turn, in connected by means of a conduit 133 to an outlet port 150 of the control valve 94. As depicted, a thermocouple 134 is mounted in operative relationship to the igniter and the pilot assembly and includes a lead 136 which is connected to a conventional control mechanism 138 mounted in the end 140 of the control valve 94.

Gas for feeding to the several burners is supplied to the insert from a source (not shown) by way of a gas regulator 142 which reduces the pressure of the incoming gas stream to a preselected constant value. As will be recognized hereinafter, this preselected pressure value is chosen to be compatible with the operating parameters of the several burners. From the regulator 142, the gas stream is directed through a conduit 144 to the inlet port 146 of the multi-position control valve 94. One suitable valve is that sold by Sourdillon, Inc., of Ringgold, Ga. under the tradename Sourdillon and known as Model 892. This control valve includes at least four operable outlet ports 92,147, 148 and 150. The depicted valve includes a fifth outlet port 152 which is not used in the present invention and which is permanently closed. The control valve 94 includes a central tapered plug (not visible in the Figures) which is capable of being manipulated between various opening and closing positions with respect to the inlet and outlet ports, as by means of a shaft 154 which is fitted with a control knob 156. As required, the shaft 154 may be provided with an extension 158. The particular valve depicted and described is provided with physical detent means for indicating at least four positions of the central tapered plug, namely, an "off" position where all outlet ports are closed, an ignition position where only the outlet port 150 is open, a "low" position where only the outlet port 150 and outlet port 148 are open and all other outlet ports are closed, a "medium" position where the outlet ports 150, 148 and 92 are open and all other outlet ports are closed, and a "high" position where all of the functional outlet ports 150, 147, 148 and 92 are open. By design, an open outlet port means that the port is fully open and gas may flow through the control valve and out through the open outlet port. In like manner, a closed outlet port is fully closed and no gas may exit outwardly through the closed port. In the depicted embodiment, the control valve 94 is mounted on the outermost surface 158 of the right-hand end panel 16 as by means of a bracket 160.

As noted hereinabove, the outlet port 92 of the control valve 94 is connected in fluid communication with the conduit 90 which leads to the cross-over tube 84 for the middle and lower burners. The orifice 98 which is interposed along the length of the conduit 90 restricts the flow of gas to the middle and lower burners to a value which is preset by means of the sizing of the opening through the orifice 88, assuming a constant pressure of gas being fed to the control valve 94.

Figure 12:
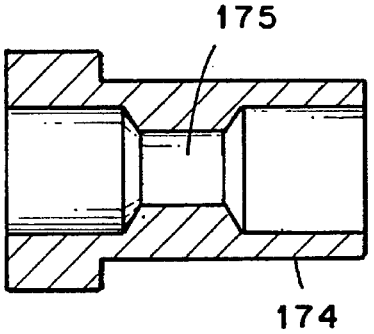
FIG. 12 is a sectional view of a restrictor as employed in the gas feed subassembly of FIG. 6.

The outlet port 148 of the control valve is connected in fluid communication with one end 168 a first feed conduit 170. The outlet port 147 of the control valve is connected in fluid communication with one end 164 of a second feed conduit 166. This first feed conduit leads from its outlet port 148, through the end panel 16 to terminate in the form of a main burner orifice 64. The end 171 of the second feed conduit is connected in fluid communication with the first feed conduit at a location interposed along the length of the first feed conduit so that gas exiting the outlet port 147 flows along the second feed conduit and into the first feed conduit at the location of their joinder 172. By this means, the volume of gas reaching the orifice 64 is a function of the total gas flow through the first and second feed conduits. As will be noted hereinafter, at times, gas will flow only through the first feed conduit to the orifice 64, hence to the main burner 48. Notably, a flow restrictor 174 (see FIGS. 3 and 12) is interposed in the first feed conduit 170 at a location downstream of the outlet port 148 and upstream of the joinder 172 of the first and second feed conduits. This restrictor functions to limit the rate of gas flow through the first feed conduit to the main burner to a preselected value which is determined by the geometry and size of the opening 175 through the restrictor. The second feed conduit has no such restrictor associated therewith so that the rate of gas flow through the second feed conduit to the main burner is a function of the flow rate of gas from the control valve, through this conduit and through the main burner orifice.

In accordance with one aspect of the present invention, the joinder 172 of the first and second feed conduits is preferably of a type which produces a rigid, non-alterable connection between these conduits. Further, each of the first and second feed conduits preferably is formed of a metal, such as aluminun or steel, so that each is bendable, but relatively rigid. For example, prior to assembly each of the first and second feed conduits must be pre-bent at their ends 164 and 168, respectively, where these conduits connect to their respective outlet ports in order for the conduits to be properly aligned with and connected to their respective ports and then to extend therefrom to be joined, be passed through the end panel 16 and be operatively positioned with respect to the open end 60 of the main burner. By reason of this structural feature of the conduits and the rigid, fixed joinder therebetween, these feed conduits, and including the restrictor in the first feed conduit, the conduits become a rigid unit which is readily handled for assembly purposes, and importantly, after assembly in the factory, is nonadjustable as respects the rate of gas flow therethrough. Further, this construction of the first and second feed conduits ensures against gas leakage at the joinder which is subject to flexing during assembly and use.

Still further, assembly of the first and second feed conduits to the end panel 16 and precise placement of the distal end 176 of the orifice 64 relative to the open end 60 of the main burner 48 is accomplished by means of a combination of a flange fitting 178 which is fixedly secured to the end 179 of the first feed conduit 170, as by soldering. This flange fitting 178 is depicted in FIGS. 3,5,6 and 9–11 and includes a through opening 179 within one end of which there is received the end 180 of the first feed conduit. The opposite end 182 of the opening 180 through the flange fitting is threaded for threadably receiving therein the orifice 64. Prior to the affixing of the flange fitting to the end of the first feed conduit, a bracket 184 (see FIGS. 3, and 5–8) is placed over the end 179 of the first feed conduit. This bracket 184 includes a central through opening 181 through which the first feed conduit is disposed. The bracket further includes a central shouldered indentation 185 intermediate its opposite ends 186 and 188 which is of a geometry and size suitable to receive therein the flange 190 of the flange fitting 178. The ends 186and 188 of the bracket are provided with slots 192 and 194 through the thickness of the bracket. Removable fastener means, such as machine screws, are fed through these slots and anchored in the end panel 16 to fixedly mount the bracket to the end panel with the flange fitting securely captured between the bracket and the outer surface 158 of the end panel, thereby facilitating the assembly of the feed conduit subassembly to the insert with the distal end of the orifice 64 correctly and fixedly mounted relative to the open end of the main burner 48. As desired, the control valve and others of the components of the gas feed arrangement located outside the support 22 adjacent the end panel 16 may be enclosed by a cover 191. Further, this cover may serve to mount the piezo-electrical generator 125 and receive therethrough the extension 158 for the control valve shaft 154 which extension is further mounted to the end panel wall 16 as by a bracket 162.

In the functioning of the present insert, gas from an outside source is fed through the regulator 142 where the pressure of the gas passing through the regulator and to the insert is established at a predetermined value. This gas, at its known pressure, is fed via the conduit 144 to the inlet port 146 of the control valve 94. When the control valve is set at its "off" position, all outlet ports of the control valve are closed and no gas passes through the control valve. When the control valve is set at its "ignition" position, only the outlet port 150 is open and gas flows to the pilot assembly 126. When the control valve is set at its "low" position, only the outlet port 150 leading to the pilot assembly and the outlet port 148 is open for the flow of gas out through this outlet port, through the restrictor 174 and through the first feed conduit 170 to exit the orifice 64. At the orifice 64, the gas is mixed with ambient air to develop a proper mixture of air and gas as will produce a blue flame at the burner ports of the main burner. It will be recognized that by means of the flow-limiting effect of the restrictor 174 in the first feed conduit, the flow of gas through the first feed conduit and to the main burner will be limited to a value which will develop a preselected quantity of heat output by the main burner. In a preferred embodiment of the present invention, this value is not greater than about 15,000 BTU when the insert is to be operated in a non-vented fashion. At the "low" setting of the control valve, no gas is admitted to the middle nor to the lower burners so that the total heat output of the insert at its "low" setting is that heat output generated by the main burner with its limited flow of gas. This flow, however, is mixed with that proportion of air which results in the generation of a blue flame emanating from the main burner.

When the control valve is set at its "medium" position, gas continues to flow out the open outlet port 150 for operating of the pilot light. Further, the outlet port 147 remains open for the flow of a limited quantity of gas to the main burner, and the outlet port 92 is open for the flow of gas from the control valve and through the conduits 86 and 90 to the cross-over tube 84 for feeding of gas to the middle and lower burners 72 and 74. This flow of gas to the cross-over tube is limited by reason of the orifice 88 which is disposed within the conduit 90. The gas flowing to the middle and lower burners is not premixed, i.e. neat gas is supplied to these burners, but rather the gas mixes with ambient air at each of the burner ports to achieve combustion. This use of neat gas in the middle and lower burners results in the generation of yellow flames 195 and 197 (see FIG. 4) at each of the burner ports of these burners. In a non-vented application, this flow of gas to the middle and lower burners is limited to that volume of gas which will generate not more than about 15,000 BTU of combined heat output by these two burners. Thus, when the insert is operated in its "medium" mode, the total heat output from the insert is approximately 30,000 BTU, this heat output being divided approximately equally between the heat output from the main burner and the combined heat output from the middle and lower burners.

Figure 2:
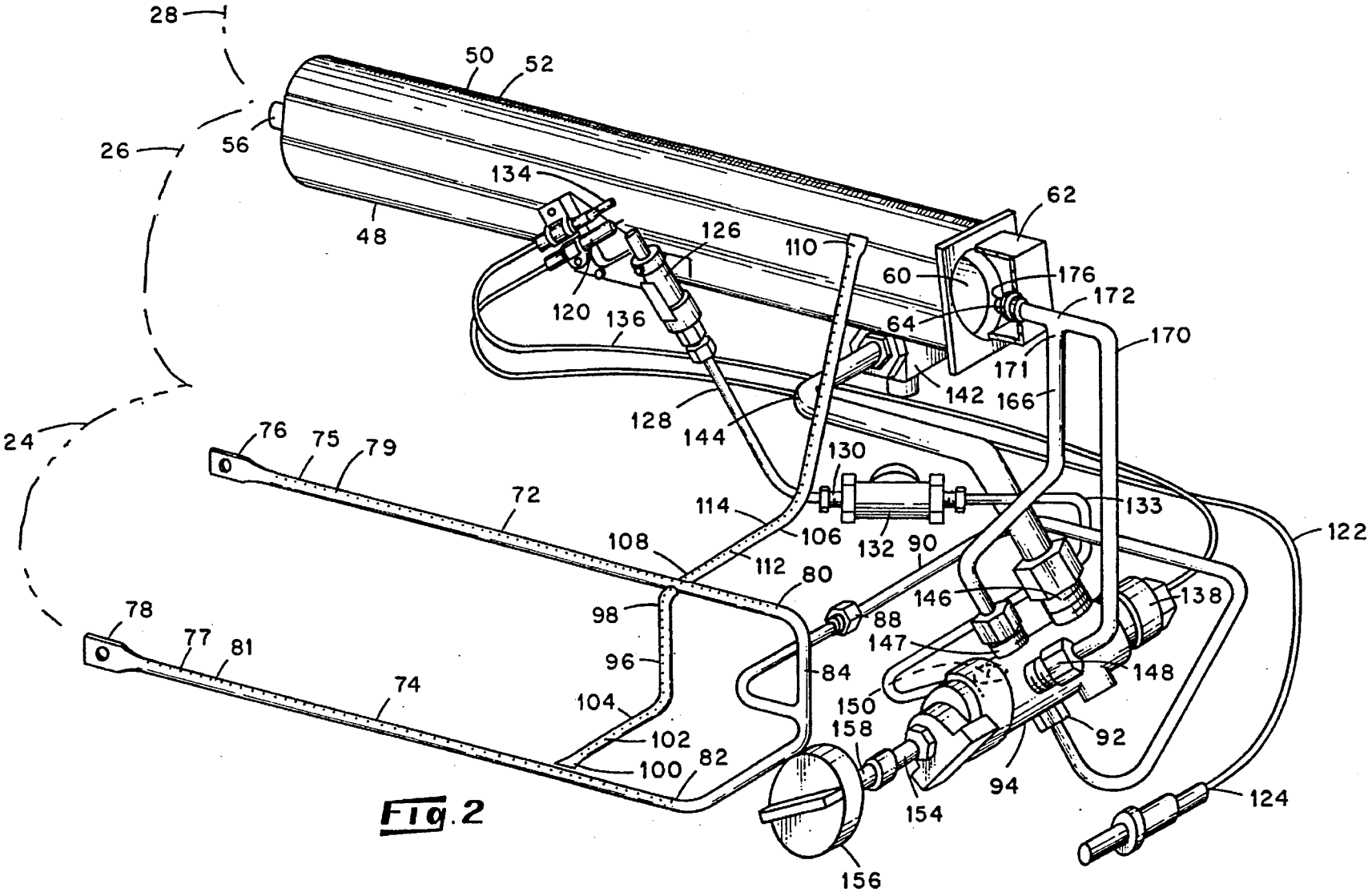
FIG. 2 is a diagrammatic representation of various components of the present insert and showing one embodiment of the interrelationship of the burners and gas feed components of the insert.

When the control valve 94 is set to its "high" position, all the outlet ports are open so that gas continues to flow from the control valve to the pilot light, to the middle and lower burners, and through the second feed conduit 170 to the main burner. At the "high" position of the control valve, the outlet port 147 also is open and additional gas flows from the control valve through the second feed conduit 166, thence into the first feed conduit 170 at the joinder 172 of these conduits, to be added to the gas which is also flowing through the first feed conduit 170. These combined streams of gas are fed through the orifice 64 where the gas is premixed with ambient air and then fed into the open end 60 of the main burner. As will be recognized, the positioning of the orifice 64 relative to the open end 60 of the main burner is critical to the attainment of proper premixing of the gas stream with air prior to the mixture entering the main burner. To this end, the end panel 16 is used as the reference point for establishing the required separation of the distal end of the orifice 64 and the open end 60 of the main burner where the mixture is ignited initially by the pilot light and continues to burn, producing blue flames from the several burner ports of the main burner. As noted hereinabove, the open end 60 of the main burner is positioned at a precise and preselected distance from the end panel 16 by means of a rigid bracket 62. This bracket, as depicted in FIG. 2, is relatively open and permits the ready flow of ambient air into the space between the open end of the main burner and the end panel. Also as noted hereinabove, the orifice 64 is fixedly mounted in an opening through the end panel 16 with the distal end 176 of the orifice is fixedly and precisely positioned a preselected distance from the end panel 16, hence fixedly and precisely positioned with respect to the open end 60 of the main burner, and is disposed within the space between the open end of the main burner and the end panel 16. The distance between the open end of the main burner and the end panel typically is about 1.2 inches and the distal end of the orifice 64 typically extends about 0.6 inch from the end panel and into the space between the open end of the main burner and the end panel, thereby positioning the distal end of the orifice about 0.6 inch from the open end of the main burner. Under conditions of unrestricted availability of ambient air to the space between the open end of the main burner and the end panel, these typical spacings of the open end of the burner and the distal end of the orifice 64 provide proper mixing of the gas flowing from the orifice with ambient air such as results in combustion of the gas/air mixture at the burner ports of the main burner and the production of blue flames from each of these burner ports. When operating in the "high" mode, the combined volume of gas flowing through the first and second feed conduits and the orifice 64 is such as will produce not more than about 25,000 BTU of heat output from the main burner. Under these conditions, the total heat output from the main burner, the middle burner and the lower burner is not more than about 40,000 BTU which is the maximum heat output allowed for non-vented operation of an insert as established by the American National Standards Institute.

Whereas it is important that the design of an insert intended for operation in a non-vented fashion be initially chosen to initially ensure that the insert can not exceed the operational limits of 200 ppm carbon monoxide and a total heat output of 40,000 BTU, is it equally, or even more important that the insert be designed to ensure continued adherence to these operational standards over extended time periods of use. One consideration in this regard is that the design of the insert prevent, to the extent reasonably possible, any alteration of the operational parameters of the insert by an end user. To these ends, the present inventor provides "built in" controls over the volume of gas which can flow to each of the burners under any given operational setting of the control valve for the insert, such as the use of the restrictor 174 in the first feed conduit 170, and the use of an orifice 88 in the conduit 90 which feeds gas to the middle and lower burners. Further, through the use of a multi-functional control valve and the preselected physically-limited distribution of the flow of gas to the several burners under conditions of "low", "medium" and "high" operational modes of the insert, the inventor ensures that at no time will any one or more of the burners of the insert be capable of operating under conditions which would produce unacceptable quantities of carbon monoxide or heat output. Still further, the use in the present insert of preassembled subassemblies such as the combination of the first and second feed conduits, including their inherent rigidity, the fixed attachment of the orifice to the first feed conduit, provide for both initial ease of assembly and aid in ensuring that any field replacement of these components follows their initial design. The advantages of this gas feed subassembly for the main burner are further enhanced through the use of the flanged fitting 178 and the accompanying bracket 184 in the mounting of the orifice 64 in the end panel 16. For example, the bracket 184 must be in place on the first feed conduit 170 prior to the connection of the orifice 64 to the end 180 of the second feed conduit 170 thereby ensuring that the gas feed subassembly must have the bracket thereon for precise mounting of the subassembly to the end panel 16. As noted hereinabove, the design of the bracket 184 is such that a central indentation therein receives the flange of the flange fitting and captures the flanged fitting between the bracket and the outer surface 158 of the end panel 16 when the bracket is mounted to this end panel. Also, it will be noted that this mode of attachment of the gas feed subassembly to the end panel using the bracket/flange fitting combination, results in the distal end of the orifice 64 being precisely positioned the proper distance from the end panel and into the space between the end panel and the open end of the main burner, which spacing is important in ensuring the proper mixing of air and gas for supplying to the main burner. In similar manner, the use by the present inventor of a preassembled combination of middle and lower burners having a single gas infeed, which infeed is controlled by an in-line orifice, and an accompanying ignition tubing arrangement which is nonremovably mounted to these burners, provides for ease of assembly of these components of the insert and ensures against field alterations which might not properly provide for ignition of gas exiting the burner ports of these burners and possible dangerous accumulation of gas within the insert. Further, in this respect, it is noted that in the present invention, no gas is allowed to flow to either of the middle or lower burners unless there is combustion occurring in the main burner, thereby providing further protection against possible accumulation of noncombusted gas within the insert.

In one embodiment of the present invention, the burner ports in the lower burner are patterned. More specifically, the burner ports are either of 0.062 inch diameter (No. 3 port size) or 0.047 inch diameter (No. 2 port size) and the ports are arranged in a line wherein the first port, starting at the left-hand end 78 of the lower burner 74, is a No. 3 port, the second port in the line is a No. 2 port, the third and fourth ports are No. 3 ports, the fifth port is a No. 2 port, and the sixth and seventh ports are No. 3 ports. This pattern of 3 2 3 3 2 3 3 is thereafter followed by a pattern of 2 3 3 2 3 3 sized ports along the remaining length of the lower burner. This arrangement of ports of different sizes has been found by the present inventor to provide a unique combination of flame sizes for a given rate of gas feed to the lower burner, these flames very closely resembling the relatively smaller yellow flames of different sizes that are found in a stack of burning wood logs. Other patterns of burner ports, including different sizings of the ports, may be selected to obtain other flame patterns of the yellow flames. In one embodiment, the burner ports of the middle burner are each chosen to be of 0.062 inch diameter so that the flames produced by the middle burner visually appear like those yellow flames and are more nearly of about the same size as the yellow flames commonly found at the middle levels of a stack of burning wood logs. In order to take maximum visual advantage of the yellow flames developed by the middle and lower burners, the middle burner is located near, and forwardly of, the bottom front edge 200 of the second log 26 and is slightly rearwardly of the rear surface 202 of the third log 24. By this means, the flames from the middle burner are directed substantially vertically upwardly between the second and third logs 24 and 26, respectively, to provide the illusion that these logs are burning. In similar manner, the lower burner is located near, and forwardly of, the bottom front edge 204 of the third log 24 and its flames are directed substantially vertically upwardly and in front of the third log to give the illusion that this third log is burning. In that embodiment where the burner hole pattern of the lower burner is varied, these flames from the lower burner also give the impression that hot coals are present in the fireplace and are producing irregularly-sized flames.

As noted hereinabove, the flames generated by the main burner are blue in color. Referring particularly to FIG. 4, in accordance with one aspect of the present invention, these flames are directed onto an outwardly inclined, and somewhat flat planar, surface 206 of the top log 28. In one embodiment, this flat surface 206 is inclined outwardly of the insert at an angle of about 35 degrees±5 degrees with respect to the vertical. As best seen in FIG. 4, the main burner includes a top side which is defined by opposite sides 208 and 210 thereof which converge inwardly and upwardly to define an apex 214 of the burner. That plane of symmetry 212 of the main burner which passes through the apex 214 of the convergent sides 208 and 210, in the depicted embodiment is inclined at about 15 degrees±5 degrees with respect to the vertical so that the flames emanating from the burner ports of the main burner tend to be directed upwardly and outwardly of the insert at an angle of about 15 degrees±5 with respect to the vertical. By this means, at least the distal tips of the flames are directed against the flat surface 206 of the top log 28 in a manner which transfers maximum heat to the surface 206 of the log 28. This action produces rapid build up of heat at this surface 206 of the log 28 and quickly causes the log to reach a temperature at which at least the surface 206 of the log 28 appears to glow with a red color and generates infrared heat that is reflected from the insert into the ambient environment. A viewer positioned in front of these flames thus visualizes the flames as having an attractive red color which closely resembles the larger and red colored flames that one sees in a stack of burning wood logs. In addition to the color enhancement of both the top log and the flames from the main burner, this arrangement further enhances the projection of heat from the insert outwardly therefrom and to the ambient environment in front of the insert. Notably, the flame and heat transfer enhancements of the present invention are achieved while keeping the total output of carbon monoxide from the combusting gas to less than about 200 ppm. It is believed by the present inventor that these observed low levels of carbon monoxide are the result of keeping the total quantity of neat gas combusted to relatively low values overall. Unexpectedly, the present inventor has found that even when using low quantities of neat gas, flame enhancement is obtained by dividing this total value of burned neat gas between two physically separated burners. Selection of the burner port sizes and patterning also contributes to the flame enhancement as noted hereinabove. Carbon monoxide levels as low as 150 ppm at a total heat output of about 40,000 BTU have been attained using an insert embodying the concepts of the present invention. It is also noteworthy that the flame enhancements are achieved with a total heat output from the insert of less than about 40,000 BTU.

Whereas it is intended that the present insert be operable in a non-vented fashion, it is recognized that various of the features of the present invention are applicable to inserts which are intended for operation in a vented fashion. For example, the advantages of the gas feed subassembly to the main burner are directly transferable to an insert intended to be operated in a vented fashion. Other advantages and modifications of the present invention will be recognized by one skilled in the art and it is intended to limit the invention only as set forth in the appended claims.

What is claimed:

1. In a gas-burning heater, including an upper tier and a lower tier of artificial logs associated therewith, the improvement comprising a first log contained in the upper tier and including a substantially planar surface which is inclined with respect to the vertical and which is oriented facing downwardly and outwardly of the heater, a second log contained in the lower tier, a first gas burner associated with said first log, said first gas burner having an inlet end, being substantially coextensive in length with said first log, and including a plurality of burner ports disposed on the upper surface and along the length thereof, said burner ports being oriented with respect to said first log as to direct flames from said burner ports toward said planar surface, a second gas burner associated with said second log, said second gas burner having in inlet end, being substantially coextensive in length with said second gas log, and including a plurality of burner ports disposed on the upper surface an along the length thereof, said burner ports being oriented with respect to said second log as to direct flames from said burner ports upwardly from said second burner and forwardly of said second log such that the flames appear to be emanating from the front of said second log, means for introducing ambient air to said inlet end of said first burner, conduit means providing an inlet stream of gas for said burners, means dividing said inlet stream of gas into first and second inlet streams to said burners for combustion at said burners, said division being such that said second burner is fed neat gas and said first burner is fed a quantity of gas which, when combined with ambient air entering said inlet end of said first burner, produces a substantially stoichiometric mixture of gas and air to produce a flame pattern upon combustion of said gas at the burner ports of said first burner that is characteristic of the substantially stoichiometric mixture, and whereby combustion of said neat gas stream at said burner associated with said lower tier of logs produces a yellow flame pattern that is characteristic of combusting neat gas, the total quantity of gas admitted to said conduit means being at all times sufficient only to limit the heat generated by the total combustion thereof to not greater which that quantity of heat and carbon monoxide which are acceptable for a nonvented gas-burning heater, whereby the flames emanating from the burner ports of said first burner and directed toward said first log locally heat said inclined surface of said first log to a visual red glow whereby said red glow is imparted to said flames from said first burner and heat from said first log is radiated therefrom into the atmosphere ambient to said heater.

2. The gas-burning heater of claim 1 wherein the total quantity of gas fed to said burners is sufficient to generate not more than a total of 40,000 BTU of heat and produces less than about 200 ppm carbon monoxide from the combined combustion of all the burners of said heater.

3. The gas-burning heater of claim 2 wherein said heater is operated in a non-vented mode.

4. The gas-burning heater of claim 1 wherein the total carbon monoxide produced by all the burners of said heater is less than about 200 ppm.

5. In a gas-burning artificial log heater which includes first and second artificial logs that are disposed one in front of the other and with the second log being located most rearwardly of and at a higher vertical level than the first log, the improvement comprising the steps of:

providing a substantially planar surface on the second artificial log, said planar surface facing forwardly of the heater and being inclined with respect to the vertical such that said planar surface faces generally downwardly and forwardly of the heater, providing a first burner in a position below and forwardly of the second log, said first burner including an inlet and burner ports from which burning gas flames may emanate and which are oriented such that the burning gas flames therefrom are directed toward said planar surface to heat the same to at least a red glow, supplying gas to a control valve, selectively feeding gas from said control valve to said inlet to said first burner in the form of independent first and second gas streams, either of which, when mixed with air and introduced to said first burner will produce blue flames emanating from said first burner, at a location between said control valve and said inlet, restricting the flow rate of one of said gas streams to a flow rate that is less than the flow rate of the other of said gas streams, whereby when gas is flowing to said first burner at the restricted flow rate, the flames generated by said first burner are less heat intense than when gas from both the first and second gas streams is fed to said first burner, when gas is selected to be fed to said first burner via said first gas stream, combining said first and second gas streams at a location downstream of said control valve and upstream of said inlet to said first burner.

6. The method of claim 5 wherein said heated second log reflects infrared heat therefrom into the ambient environment.

7. The method of claim 5 and including the steps of providing a second burner in a position below and forwardly of the first log, and controlling the volume of said gas and/or gas/air mixture being fed to said first and second burners to that volume which when combusted at said burners results in the production of less than about 200 ppm of carbon monoxide.

8. The method of claim 5 and including the step of controlling the volume of said gas and/or gas/air mixture being fed to said first and second burners to that volume which when combusted at said burners results in the production of less than about 40,000 BTUs of total heat output from said heater.

9. The method of claim 5 and including the step of disposing said heater in a non-vented operating environment.

10. The method of claim 5 and including the step of positioning said second burner associated with said firs log forwardly of said first log such that flames emanating therefrom are visible in front of said first log.

11. The improvement of claim 5 and including the step of preventing the flow of gas to said first burner via said first gas stream at all times when gas is not flowing to said first burner via said second gas stream.

12. In a gas burning heater including an upper tier that includes an artificial log associated therewith and which extends substantially between the opposite sides of the heater, the improvement comprising a substantially planar surface on the log, said surface being inclined with respect to the vertical and oriented facing downwardly and outwardly of the heater, a gas burner associated with the log, said gas burner having an inlet end, being substantially coextensive in length with the log, aligned with the length dimension of the log, and including a plurality of burner ports disposed on the upper surface and along the length thereof, said burner ports being oriented with respect to the log as to direct flames from said burner ports toward said substantially planar surface, means for introducing ambient air to said inlet end of the burner, valve means for controlling the flow of gas to said burner, conduit means disposed between said valve means and said inlet end to said burner and providing an inlet stream of gas to said burner, which stream of gas, when combined with ambient air to form a substantially stoichiometric mixture, and ignited within said burner, produces a flame pattern that is characteristic of a combusting substantially stoichiometric mixture of gas and air, and said flame pattern is directed toward said inclined surface of the log to locally heat said inclined surface and heat from said inclined surface is radiated therefrom into the atmosphere ambient to the heater.

13. The heater of claim 12 wherein said conduit means includes a single outlet end adjacent the burner for introducing a single stream of gas to the burner inlet end and is bifurcated into first and second branches at a location adjacent said valve means to convey gas away from said valve means in separate streams, said first and second branches becoming a single conduit at a location downstream of said inlet end of said burner, means associated with said valve means for selectively directing gas to said first and second branches of said conduit means, means associated with one of said first and second branches of said conduit means for reducing the capacity of said one of said branches for gas to flow therethrough to a value less than the flow capacity of gas through the other of said first and second branches of said conduit means, whereby when gas is admitted only to said branch having reduced flow capacity, said burner produces flames of a first heat value, and when gas is admitted simultaneously to both said first and second branches, said burner produces a second heat value that is greater than said first heat value.

* * * * *